United States Patent [19]

Engelhaupt

[11] 4,290,858

[45] Sep. 22, 1981

[54] PROCESS FOR FORMING A NICKEL FOIL WITH CONTROLLED AND PREDETERMINED PERMEABILITY TO HYDROGEN

[75] Inventor: Darell E. Engelhaupt, Kansas City, Mo.

[73] Assignee: The United States of America as represented by the United States Department of Energy, Washington, D.C.

[21] Appl. No.: 189,991

[22] Filed: Sep. 23, 1980

[51] Int. Cl.[3] ..... C25D 1/04; C25D 3/12

[52] U.S. Cl. ..... 204/12; 204/49; 204/DIG. 13

[58] Field of Search ..... 204/3, 11, 12, 49, DIG. 13, 204/4

[56] References Cited

U.S. PATENT DOCUMENTS

| | | | |
|---|---|---|---|
| 2,112,818 | 3/1938 | Waite | 204/49 |
| 2,198,267 | 4/1940 | Lind | 204/49 |
| 2,467,580 | 4/1949 | Brown | 204/49 |
| 2,513,280 | 7/1950 | Brown | 204/49 |
| 3,326,782 | 6/1967 | Kendrick | 204/3 |
| 3,594,288 | 7/1971 | Reinert | 204/49 |
| 3,677,913 | 7/1972 | Passal | 204/49 |

OTHER PUBLICATIONS

Plating, Nov. 1972, pp. 1033–1037.

*Primary Examiner*—T. M. Tufariello
*Attorney, Agent, or Firm*—Armand McMillan; Albert Sopp; Richard G. Besha

[57] ABSTRACT

The present invention provides a novel process for forming a nickel foil having a controlled and predetermined hydrogen permeability. This process includes the steps of passing a nickel plating bath through a suitable cation exchange resin to provide a purified nickel plating bath free of copper and gold cations, immersing a nickel anode and a suitable cathode in the purified nickel plating bath containing a selected concentration of an organic sulfonic acid such as a napthalene-trisulfonic acid, electrodepositing a nickel layer having the thickness of a foil onto the cathode, and separating the nickel layer from the cathode to provide a nickel foil. The anode is a readily-corrodible nickel anode. The present invention also provides a novel nickel foil having a greater hydrogen permeability than palladium at room temperature.

11 Claims, 1 Drawing Figure

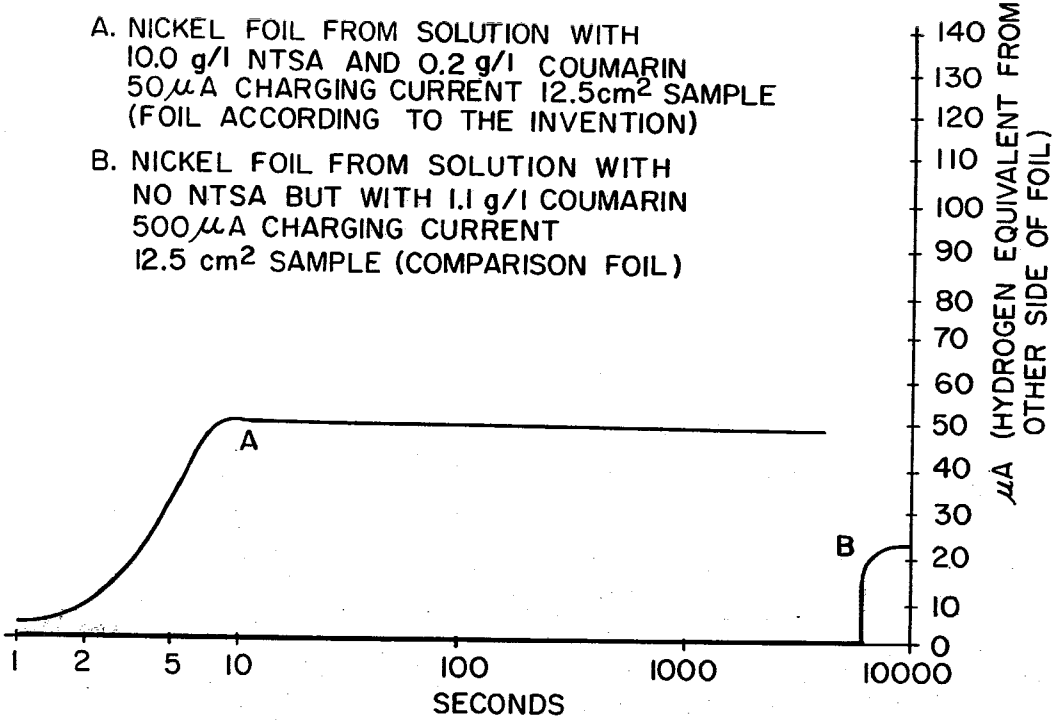
A. NICKEL FOIL FROM SOLUTION WITH
10.0 g/l NTSA AND 0.2 g/l COUMARIN
50μA CHARGING CURRENT 12.5cm² SAMPLE
(FOIL ACCORDING TO THE INVENTION)
B. NICKEL FOIL FROM SOLUTION WITH
NO NTSA BUT WITH 1.1 g/l COUMARIN
500μA CHARGING CURRENT
12.5 cm² SAMPLE (COMPARISON FOIL)
μA (HYDROGEN EQUIVALENT FROM
OTHER SIDE OF FOIL)
140
130
120
110
100
90
80
70
60
50
40
30
20
10
0
1
2
5
10
100
1000
10000
SECONDS
A
B

PROCESS FOR FORMING A NICKEL FOIL WITH CONTROLLED AND PREDETERMINED PERMEABILITY TO HYDROGEN

The United States Government has rights in this invention pursuant to Contract No. EP 041244 between the United States Department of Energy and Bendix Corporation, Kansas City, Mo. (41 CFR S9-9.109-6(i) (5) (ii) (B)).

BACKGROUND OF THE INVENTION

This invention relates to the formation of a nickel foil using electrodeposition from a nickel plating bath. More particularly, this invention relates to the formation of a nickel foil with controlled permeability to hydrogen by electrodeposition of a nickel layer from a nickel plating bath.

In the prior art, it is known to electrodeposit nickel from a nickel plating bath containing an organic sulfonic acid. Illustrative of this type of prior art is U.S. Pat. No. 2,112,818 to Waite, U.S. Pat. No. 2,198,267 to Lind et al., U.S. Pat. No. 2,467,580 to Brown, U.S. Pat. No. 2,513,280 to Brown, U.S. Pat. No. 3,594,288 to Reinert, "Nickel Plating from Sulfamate Solutions Part III," *Metal Finishing Journal,* p. 234 (August 1970) by Hammond, and "The Effects of Some Variables Upon Hardness of Sulfamate Nickel Deposits," presented at the International Symposium on the Uses of Sulfamic Acid, Milan, Italy (1967) by Marti et al., Barrett Chemical Products Division, Allied Research Products, Incorporated, Detroit, Mich. Reinert, in addition, shows that it is known to electrodeposit a nickel layer onto stainless steel using a nickel sulfamate plating bath containing a naphthalenetrisulfonic acid, and Hammond and Marti et al. use 1,3,6-naphthalenetrisulfonic acid in a nickel sulfamate bath. Also known is the codeposition of sulfur as an occlusion with nickel, with this type of art being exemplified by Konishi, "Duplex Nickel Plating," *Metal Finishing,* Vol. 63, p. 67 (April 1965).

In none of this art and in none of the prior art of which I am aware, is an organic sulfonic acid added to a nickel plating bath in a selected concentration to form a nickel foil having a predetermined hydrogen permeability. Rather, organic sulfonic acids such as 1,3,6-naphthalenetrisulfonic acid are used to promote stress reduction and hardness by incorporating sulfur in the deposit as occlusions. Also, organic sulfonic acids are used in order to electrodeposit a bright ductile nickel plate.

It is also known to use coumarin as a leveling agent in a nickel plating bath. This type of prior art is illustrated by U.S. Pat. No. 3,677,913 to Passal, and Rigers et al., "The Effects of Coumarin on the Deposition of Nickel," *Electrochemica Acta,* Vol. 8, p. 887 (1963). Furthermore, removal of melilotic acid contaminant, a reduction product of coumarin, from a nickel plating bath by use of a cation exchange resin is known, as exemplified by Wu et al., "Automatic Purification of Coumarin-Containing Nickel Plating Baths," *Plating,* Vol. 59, p. 1033 (Nov. 1972).

In none of this art and in none of the prior art of which I am aware, is there a process for forming a nickel foil with controlled and predetermined permeability to hydrogen.

With the current energy shortage, hydrogen is of interest as a means of delivering energy from non-fossil primary energy resources such as nuclear, geothermal and solar energy conversion processes. Hydrogen can be produced from water by means of one or more water-splitting processes such as water electrolysis. Key problem areas in using hydrogen to deliver energy include production, storage and transmission. For the production, transfer or storage of hydrogen, a material with a high permeability to hydrogen is often desired. Palladium is such a material, and although it is very expensive, it is often employed for these purposes. Thus, there is a need for a less expensive material having high hydrogen permeability that can be used for the production, transfer or storage of hydrogen. Also, there is a need for a reproducible process to produce a material of this type.

SUMMARY OF THE INVENTION

It is accordingly one object of the invention to provide a process for forming a nickel foil with controlled and predetermined permeability to hydrogen.

A further object is to provide a material less expensive than palladium that has high permeability to hydrogen, for the production, transfer or storage of hydrogen.

An even further object is to provide a process that reproducibly provides a material having high hydrogen permeability and that is less expensive than palladium. This material could be used for the production, transfer or storage of hydrogen.

Additional objects, advantages, and novel features of the invention will be set forth in the description which follows, and in part, will become apparent to those skilled in the art upon examination of the following, or may be learned by practice of the invention. The objects and advantages of the invention may be realized and attained by means of instrumentalities and combinations particularly pointed out in the appended claims.

To achieve the foregoing objects and in accordance with the purpose of the invention, as embodied and broadly described herein, the present invention is directed to a process for forming a nickel foil with controlled and predetermined permeability to hydrogen. This process includes the steps of passing a nickel plating bath through a copper and gold cation-removing cation exchange resin whereby a purified nickel plating bath free of copper and gold cations is provided, immersing a readily-corrodible nickel anode and a cathode in the purified bath containing a selected concentration of an organic sulfonic acid, electrodepositing a nickel layer having the thickness of a foil directly onto the cathode while maintaining the cathode current density and bath temperature at selected values, and separating the electrodeposited nickel layer from the cathode to provide a nickel foil. As a result, the nickel foil has a controlled and predetermined hydrogen permeability. The cathode is suitable for electrodeposition of nickel thereon and is separable from an electrodeposited nickel layer.

In a preferred embodiment of the process, the purified nickel plating bath contains about 75–90 gm/liter nickel, about 30–40 gm/liter boric acid, about 4–6 gm/liter magnesium chloride, about 0.75 gm/liter sodium lauryl sulfate, about 0.15–0.5 gm/liter coumarin, and about 10 gm/liter 1,3,6-naphthalenetrisulfonic acid as the organic sulfonic acid additive. This bath has a pH ranging from about 3.8–4.2. In this preferred embodiment, the electrodepositing step is carried out at a bath temperature of about 50° C. and at a cathode current density of about 20 ma/cm$^2$. The coumarin is added to the bath after the purification step has been carried out.

The readily-corrodible nickel anode is made of sulfur depolarized nickel, the cathode is stainless steel, and the nickel foil produced has a thickness of from about 0.025 to 0.1 mm. The nickel foil produced by this preferred embodiment is novel and has a greater hydrogen permeability than palladium at room temperature.

BRIEF DESCRIPTION OF THE DRAWING

Reference is hereby made to the accompanying drawing which forms a part of the specification of this application. This drawing shows comparative hydrogen permeation between a foil according to the invention and a comparison foil.

DETAILED DESCRIPTION OF THE INVENTION

As explained above, in accordance with my invention, there is provided a novel process for forming a nickel foil having a controlled and predetermined hydrogen permeability, and there is provided a novel nickel foil having a greater permeability to hydrogen at room temperature than palladium. My invention is based substantially upon the discovery that the hydrogen permeability of a nickel foil is related to the concentration of an organic sulfonic acid in a nickel plating bath, when the bath is free of copper and gold cations.

In the first essential step of my process, in accordance with the invention, I provide a nickel plating bath that is free of copper and gold cations by passing a nickel plating bath through a suitable cation exchange resin. This resin has a high affinity for noble atoms such as copper and gold in low concentration and has a high affinity for coumarin-type organics and for derivatives of coumarin such as melilotic acid. Illustratively, the cation exchange resin is Amberlite XAD-2, available from Rohm and Haas, and Waters Associates Porocil C, with Amberlite XAD-2 being preferred. It is necessary that the bath be free of copper and gold cations since trace contamination by either copper or gold causes the correspondence between hydrogen permeability of the nickel foil and the concentration of the organic sulfonic acid to disappear. When the bath contains coumarin as a leveling agent, the coumarin must be added to the bath after carrying out the purification with the cation exchange resin. The organic sulfonic acid is added to the bath, either prior to or after bath purification. The purification procedure is carried out using conventional techniques, that is, the resin is packed in a suitable column and the bath is passed through the packed column. In the subsequent steps, the plating bath referred to is the purified nickel plating bath just described.

In accordance with my invention, in the second essential step of my process, a suitable cathode and a readily-corrodible nickel anode are immersed in the purified nickel plating bath. The requirements for the cathode are that it be suitable for electrodeposition of nickel thereon and that it be separable from the electrodeposited nickel. Additionally, the cathode must not be made of a metal such as indium or gallium that would alloy with the electrodeposited nickel. Suitably, the cathode is made of stainless steel, copper, brass, or aluminum, with stainless steel being preferable for the reason explained below. The nickel anode is illustratively made of a sulfur depolarized nickel, with an anode of this type being commercially available from the International Nickel Corporation.

As another necessary feature of my invention, the nickel plating bath contains an organic sulfonic acid. I have discovered that the hydrogen permeability of a nickel foil is related to the concentration of an organic sulfonic acid in a nickel plating bath, when the bath is free of copper and gold cations. Specifically, I have discovered that a nickel foil of relatively greater permeability to hydrogen is obtained when a relatively greater concentration of an organic sulfonic acid is used in the plating bath, whereas a nickel foil having a relatively lower permeability to hydrogen is obtained when a relatively lower concentration of an organic sulfonic acid is used in the plating bath. I have further discovered that there is a point after which the permeability to hydrogen does not appreciably increase, but is, for practical purposes, essentially constant. After this point, use of the organic sulfonic acid in a higher concentration, therefore, does not result in any appreciable increase in permeability of the nickel foil to hydrogen. As explained, the hydrogen permeability is related to the concentration of an organic sulfonic acid used in a nickel plating bath. Thus, to produce a nickel foil having a predetermined and controlled hydrogen permeability, an appropriate concentration of an organic sulfonic acid is selected for use in a nickel plating bath. Generally, the concentration of the organic sulfonic acid is in the range of about 0.1 to 20 gm/litre.

The organic sulfonic acid may, for example, be any of the organic sulfonic acids disclosed at page 3, column 1, lines 19–29 of U.S. Pat. No. 2,112,818 to Waite; at column 1, line 35 through column 2, line 23 of U.S. Pat. No. 2,467,580 to Brown; in Table II of U.S. Pat. No. 2,513,280 to Brown; and in Table II of U.S. Pat. No. 2,198,267 to Lind et al., with a naphthalenesulfonic acid being advantageous. The napthalenesulfonic acid is a naphthalene mono-, di-, or trisulfonic acid. More than one organic sulfonic acid may be used but no advantage is known to be produced. A particularly advantageous organic sulfonic acid is 1,3,6-napthalenetrisulfonic acid (NTSA), which is conveniently used in a concentration ranging from about 0.1 to 15 mg/liter. In the case of NTSA, hydrogen permeability of the nickel foil is substantially proportional to the concentration of NTSA selected for use in the bath, when about 0.1 to less than 10 gm/liter NTSA is used. However, from about 10–15 gm/liter NTSA, the hydrogen permeability of the nickel foil is substantially the same.

In accordance with the invention, in the next essential step of my process, there is electrodeposited directly onto the cathode described above, a nickel layer having the thickness of a foil. Suitably, the thickness is from about 0.025–0.1 mm. The cathode current density and bath temperature are maintained at selected values during this step. To facilitate the subsequent separation step, the cathode is not coated with a thin nickel base coat by means of a nickel strike prior to carrying out this step.

The operating conditions, that is, the cathode current density and bath temperature, for performing the electrodeposition step, depend upon the particular nickel plating bath used in my process. Thus, if the nickel plating bath is, for example, a nickel sulfate bath such as the Watts' type, or an all-chloride, nickel-chloride plating bath, appropriate operating conditions that are conventionally used with the bath are selected. The time for this step depends on factors such as the cathode current density and the desired thickness of the electrodeposited nickel layer, with, for example, a greater thickness requiring more time than a lesser thickness, at a particular cathode current density.

A convenient nickel plating bath for use in my process is a nickel sulfamate bath that contains about 75–90 gm/liter nickel, about 30–40 gm/liter boric acid, about 4–6 gm/liter magnesium chloride, about 0.75–1.0 gm/liter sodium lauryl sulfate, and from 0 up to about 0.5 gm/liter coumarin. The nickel is provided by nickel sulfamate, and this bath has a pH ranging from about 3.8–4.2. When this bath is used in my process, the electrodepositing step is carried out at a selected temperature in the range of about 45°–60° C. and at a selected cathode current density between about 5–100 ma/cm$^2$. It is especially convenient for this nickel plating bath to contain about 0.75 gm/liter of sodium lauryl sulfate and about 0.15–0.5 gm/liter of coumarin, and for the electrodepositing step to be carried out at a temperature of about 50° C. and at a cathode current density of about 20 ma/cm$^2$. This especially convenient bath, without the coumarin additive, has been used by the Bendix Corporation, Kansas City Division for some time, and these especially convenient operating conditions are essentially those defined by D. Endicott and J. Knapp, Jr., in "Electrodeposition of Nickel-Coblt Alloy," American Electroplaters Society (January 1966), while studying the deposition of a nickel-cobalt alloy.

In the next essential step of my process, in accordance with the invention, the electrodeposited nickel layer is separated from the cathode to provide a nickel foil. This separation is achieved, for example, by peeling the nickel layer from the cathode when stainless steel is used as the cathode. Easy removal of the nickel layer from stainless steel makes this metal the preferred cathode for use in my process. If copper, brass or aluminum is used as the cathode, the separation is conveniently achieved by dissolving the cathode, thereby leaving behind a nickel foil. In the case of aluminum, a mild sodium hydroxide solution containing about 10 wt. percent sodium hydroxide is used for dissolving the aluminum. If copper or brass is used as the cathode, I have discovered that a composition obtained by dissolving in each liter of water about 150 grams of a mixture of about 50% ammonium carbonate, about 10% sodium polysulfide and about 40% ammonium persulfate, dissolves either of these metals to leave behind a nickel foil. I maintain the composition used for dissolving a copper or brass cathode at a pH of about 9–10 by using sodium hydroxide. As a result of my process, there is obtained a nickel foil having a predetermined and controlled hydrogen permeability.

In a preferred embodiment of my process, the especially convenient nickel sulfamate plating bath described above is used. This bath is provided free of copper and gold cations by purification with the cation exchange resin described above. The purification is carried out before addition of the coumarin. The anode is made of sulfur depolarized nickel, the cathode is stainless steel, and the bath contains about 10 gm/liter NTSA. This embodiment produces a novel nickel foil in accordance with my invention. This nickel foil has a greater hydrogen permeability than palladium at room temperature, and has a thickness of from about 0.025 to 0.1 mm. The hydrogen permeability of palladium is shown and described in Devanathan et al., "The Adsorption and Diffusion of Electrolytic Hydrogen in Palladium," *Proceedings of the Royal Society,* Vol. A270, p. 90 (1962), the pertinent portion of the disclosure of which is hereby incorporated by reference into this application.

The below examples are illustrative of my invention. It is to be understood that these examples are not in any way to be interpreted as limiting the scope of the invention. Rather, it is intended that the scope of the invention be defined by the claims appended hereto.

EXAMPLE 1

A nickel plating bath containing 75–90 gm/liter nickel metal (as the sulfamate), 30–40 gm/liter boric acid, 4–6 gm/liter magnesium chloride and 0.75 gm/liter sodium lauryl sulfate is prepared. The bath has a pH ranging from 3.8–4.2. This bath is purified by being passed through a column packed with Amberlite XAD-2, obtained from Rohm and Haas. To the purified bath, which is free of copper and gold cations, there is added 1,3,6-naphthalenetrisulfonic acid (NTSA) and coumarin so as to provide the concentrations of NTSA and coumarin shown in Table 1. Using a sulfur depolarized nickel anode and a stainless steel cathode, a nickel layer is electrodeposited at a bath temperature of 50° C. and a cathode current density of 20 ma/cm$^2$. The electroplated nickel layer, which has the thickness of a foil, is separated from the cathode and then tested for hydrogen diffusivity following the testing procedure of Chatterjee et al. in "Effect of Electrodeposited Metals on the Permeation of Hydrogen Through Iron Membranes," Technical Report No. 8, Office of Naval Research, Contract No, N000-14-75-C0264, and Devanathan et al., "The Adsorption and Diffusion of Electrolytic Hydrogen in Palladium," *Proceedings of the Royal Society,* Vol. A270, p. 90 (1962). The result is shown in Table 1.

EXAMPLES 2–4

Following the procedure of Example 1, except that the concentrations of NTSA shown in Table 1 for Examples 2–4 are used, there is obtained in each case a foil of comparable thickness. Each foil is tested for hydrogen permeability, as in Example 1, and the results are shown in Table 1. Additionally, there is shown in Table 2, further details concerning the hydrogen permeability of the nickel foil using 9 gm/liter NTSA.

TABLE 1

| Example | NTSA (gm/l) | Coumarin (gm/l) | Hydrogen Diffusivity[1] (cm$^2$/s) |
|---|---|---|---|
| 1 | 2.5 | 0.3 | $3.0 \times 10^{-7}$ |
| 2 | 5.0 | 0.3 | $5.2 \times 10^{-6}$ |
| 3 | 7.5 | 0.3 | $7.5 \times 10^{-5}$ |
| 4 | 9.0 | 0.3 | $1.7 \times 10^{-5}$ |
| Comparative Example | | | |
| 1 | 0 | 0 | $1.2 \times 10^{-8}$ |
| 2 | 0 | 0.3 | $5.6 \times 10^{-10}$ |
| 3 | 9.0 | 0.3[2] | $1.05 \times 10^{-6}$ |

[1]Calculated using the equation $cm^2/s = \frac{L^2}{t_B}(1/6-1/\pi^2)$ where L is the foil thickness and $t_B$ is the time for hydrogen breakthrough.
[2]Plating bath additionally contains 200 ppm gold and 500 ppm copper.

TABLE 2

| | J μA/cm$^2$ | D cm$^2$/s | m (D/L) cm/s | P μA | % P Ic/IA |
|---|---|---|---|---|---|
| Example 4 | 40 | $1.7 \times 10^{-5}$ | $3.3 \times 10^{-3}$ | 40.0 | 100 |
| Comparative Example 2 | 40 | $5.64 \times 10^{-10}$ | $7.4 \times 10^{-8}$ | 1.76 | 4 |
| Comparative | 400 | $1.2 \times 10^{-8}$ | $4.0 \times 10^{-6}$ | 4.0 | 1 |

TABLE 2-continued

| | J $\mu A/cm^2$ | D $cm^2/s$ | m (D/L) cm/s | P $\mu A$ | % P Ic/IA |
|---|---|---|---|---|---|
| Example 1 | | | | | |

COMPARATIVE EXAMPLES 1-3

Following the procedure of Example 1, except that the concentrations of NTSA and coumarin shown in Table 1 for these comparative examples are used, there is prepared in each case a nickel foil that is tested for hydrogen diffusivity, as in Example 1. The results are shown in Table 1. Additionally, Table 2 shows additional details concerning the tests for hydrogen diffusivity for comparative Examples 1 and 2.

EXAMPLE 5

Following the procedure of Example 1, except that the concentration of NTSA is 10.0 gm/liter and the concentration of coumarin is 0.15 gm/liter, there is electroplated a nickel layer having a thickness of 0.075 mm. Using the testing procedure of Example 1, this foil demonstrates that about 98% of the total hydrogen flux generated electrochemically on one side thereof would be measured on the opposite side in 15 seconds or less with charging currents of from 3-10 micro amps per square centimeter. This foil has a greater hydrogen permeability than palladium at room temperature.

The drawing shows the hydrogen permeability of a similar foil prepared by the procedure described in the previous paragraph, except that the bath contains 0.2 gm/liter coumarin. This foil also has a greater hydrogen permeability than palladium at room temperature.

COMPARATIVE EXAMPLE

Following the procedure of Comparative Example 2, except that the nickel plating bath contains 1.1, rather than 0.3, gm/liter, coumarin, there is obtained a nickel foil of comparable thickness. The hydrogen permeability of this foil is compared in the drawing with one of the nickel foils of Example 5. This nickel foil demonstrates that only about 4.5% of the total hydrogen flux generated electrochemically on one side of the foil would be measured on the other side and the permeation time was about 12 minutes when the charging current was 40 micro amps per square centimeter.

My process is useful for providing a nickel foil with controlled and predetermined hydrogen permeability. Furthermore, my process is useful for providing a material less expensive than palladium that has a high permeability to hydrogen. This material is useful for the production, transfer or storage of hydrogen.

I claim:

1. A process for forming a nickel foil having a controlled and predetermined hydrogen permeability, said process comprising the steps of (a) passing a nickel plating bath through a copper and gold cation-removing cation exchange resin, whereby there is provided a purified nickel plating bath free of copper and gold cations;

(b) immersing a readily-corrodible nickel anode and a cathode in said purified bath comprising a selected concentration of an organic sulfonic acid; said cathode being suitable for electrodeposition of nickel thereon and being separable from an electrodeposited nickel layer;

(c) electrodepositing a nickel layer having the thickness of a foil directly onto said cathode, while maintaining the cathode current density and bath temperature at selected values; and (d) separating the electrodeposited nickel layer from said cathode to provide a nickel foil; whereby said nickel foil has a controlled and predetermined hydrogen permeability.

2. The process of claim 1, wherein said organic sulfonic acid is a naphthalenesulfonic acid.

3. The process of claim 2, wherein said purified bath comprises about 0.1 to 15 gm/liter of 1,3,6-naphthalenetrisulfonic acid.

4. The process of claim 3, wherein said purified bath further comprises about 75-90 gm/liter nickel, about 30-40 gm/liter boric acid, about 4-6 gm/liter magnesium chloride, about 0.75-1.0 gm/liter sodium lauryl sulfate, and from 0 up to about 0.5 gm/liter coumarin; said nickel being provided by nickel sulfamate, and said purified bath having a pH ranging from about 3.8-4.2; wherein the electrodepositing step is carried out at a selected temperature in the range of about 45°-60° C., and at a selected cathode current density between about 5-100 $ma/cm^2$; and wherein the purification step is carried out before the addition of coumarin, when coumarin is an additive.

5. The process of claim 4, wherein the amount of sodium lauryl sulfate in said purified bath is about 0.75 gm/liter, wherein the amount of coumarin in said purified bath is about 0.15-0.5 gm/liter, and wherein the electrodepositing step is carried out at a temperature of about 50° C. and at a cathode current density of about 20 $ma/cm^2$.

6. The process of claim 1, wherein said readily-corrodible nickel anode is made of sulfur depolarized nickel.

7. The process of claim 1, wherein said cathode is made of a metal selected from the group consisting of stainless steel, copper, brass and aluminum.

8. The process of claim 7, wherein said cathode is made of stainless steel.

9. The process of claim 5, wherein said readily-corrodible nickel anode is made of a sulfur depolarized nickel, wherein said cathode is stainless steel, wherein said purified bath comprises about 10 gm/liter, 1,3,6-napthalenetrisulfonic acid; and wherein said nickel foil has a thickness between about 0.025 to 0.1 mm.

10. The process of claim 1, wherein said cathode is brass or copper, and wherein the separation step is carried out by solubilizing the cathode in a dissolving composition comprising in each litre of water about 150 grams of a mixture of about 50% ammonium carbonate, about 10% sodium polysulfide and about 40% ammonium persulfate.

11. A nickel foil produced by the process of claim 9, said nickel foil having greater hydrogen permeability than palladium at room temperature.

* * * * *